US010787951B2

(12) United States Patent
Dougherty et al.

(10) Patent No.: US 10,787,951 B2
(45) Date of Patent: Sep. 29, 2020

(54) PIPE AND METAL SHEET SUBASSEMBLY FOR AN EXHAUST TREATMENT DEVICE

(71) Applicant: Tenneco Automotive Operating Company Inc., Lake Forest, IL (US)

(72) Inventors: James Dougherty, Ypsilanti, MI (US); Wendall T. Heaton, Clark Lake, MI (US); Joshua Ottobre, Munith, MI (US); Steven M. Rakowski, Eaton Rapids, MI (US); Lawrence J. Noren, IV, Springport, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 352 days.

(21) Appl. No.: 15/817,721

(22) Filed: Nov. 20, 2017

(65) Prior Publication Data

US 2019/0153925 A1 May 23, 2019

(51) Int. Cl.

| | |
|---|---|
| ***F01N 13/18*** | (2010.01) |
| ***F01N 1/02*** | (2006.01) |
| ***F01N 1/08*** | (2006.01) |

(52) U.S. Cl.

CPC ..... *F01N 13/1827* (2013.01); *F01N 1/02* (2013.01); *F01N 1/083* (2013.01); *F01N 1/084* (2013.01);

(Continued)

(58) Field of Classification Search

CPC ..... F01N 13/1827; F01N 1/02; F01N 1/083; F01N 1/084; F01N 13/1838;

(Continued)

(56) References Cited

U.S. PATENT DOCUMENTS 4,744,440 A * 5/1988 Hanson ..... F01N 1/003 181/227
5,559,308 A * 9/1996 Hayashi ..... F01N 1/02 181/265

(Continued)

FOREIGN PATENT DOCUMENTS

CN 103410586 A 11/2013
CN 106246295 A 12/2016

(Continued)

OTHER PUBLICATIONS

International Search Report and Written Opinion for PCT/US2018/061260, dated Mar. 7, 2019; 8 pages.

*Primary Examiner* — Forrest M Phillips
(74) *Attorney, Agent, or Firm* — Harness, Dickey & Pierce, P.L.C.

(57) ABSTRACT

A method of manufacturing a subassembly for an exhaust treatment device includes providing a metal sheet including first and second apertures having respective first and second sizes, and a one-piece pipe including first and second linear portions having respective third and fourth sizes. The method further includes defining the first size based on a first difference between the first size and the third size being less than or equal to a predetermined value, and defining the second size based on manufacturing tolerances of the pipe to assure that the second linear portion will pass through the second aperture while the first linear portion passes through the first aperture. The method further includes fixing the first linear portion to the sheet, expanding the second linear portion from the fourth size to an enlarged size less than or equal to the predetermined value, and fixing the second linear portion to the sheet.

20 Claims, 5 Drawing Sheets

(52) U.S. Cl.
CPC ..... *F01N 13/185* (2013.01); *F01N 13/1838* (2013.01); *F01N 13/1844* (2013.01); *F01N 13/1872* (2013.01); *F01N 2470/14* (2013.01); *F01N 2470/18* (2013.01); *F01N 2490/02* (2013.01); *F01N 2490/08* (2013.01)

(58) Field of Classification Search
CPC ..... F01N 13/1844; F01N 13/185; F01N 13/1872; F01N 2470/18; F01N 2490/02; F01N 2490/08
USPC ..... 181/228
See application file for complete search history.

(56) References Cited

U.S. PATENT DOCUMENTS 5,907,134 A * 5/1999 Nording ..... F01N 13/08 138/113
6,571,911 B2 * 6/2003 Watanabe ..... F01N 1/02 181/265
7,543,682 B2 * 6/2009 Hanitzsch ..... F01N 1/089 180/309
7,650,965 B2 1/2010 Thayer et al.
7,918,311 B2 4/2011 Matsueda et al.
7,934,583 B2 5/2011 Reuther et al.
8,051,949 B2 11/2011 Henke et al.
8,813,362 B2 8/2014 Brandt et al.
8,939,254 B2 1/2015 Schmitt et al.
9,212,579 B2 12/2015 Han et al.
9,689,301 B2 6/2017 Carr et al.

FOREIGN PATENT DOCUMENTS

CN 106368787 A 2/2017
JP 2013241852 A 12/2013

* cited by examiner

PIPE AND METAL SHEET SUBASSEMBLY FOR AN EXHAUST TREATMENT DEVICE

FIELD

The present disclosure relates to a pipe and metal sheet subassembly for an exhaust treatment device for receiving exhaust gas from a combustion engine.

BACKGROUND

This section provides background information related to the present disclosure which is not necessarily prior art.

Exhaust treatment devices, such as mufflers, may include subassemblies having one or more metal sheets and one or more pipes. A metal sheet may be a shell, an end cap, or an internal baffle, partition, or support. The pipes may direct exhaust flow and may be straight or curved. A curved pipe may include a 180° bend (e.g., J pipe or U pipe), a 90° bend, or multiple bends (e.g., S pipe). Curved pipes may be manufactured in a bending operation, resulting in a relatively large true position tolerance between the respective inlet and outlet centerlines. The present disclosure provides a pipe and metal sheet subassembly for an exhaust treatment device, and methods of manufacturing the pipe and metal sheet subassembly.

SUMMARY

This section provides a general summary of the disclosure, and is not a comprehensive disclosure of its full scope or all of its features.

In accordance with an aspect of the subject disclosure, a method of manufacturing a subassembly for an exhaust treatment device for receiving exhaust gas from a combustion engine includes providing a metal sheet and a one-piece pipe. The metal sheet includes a first aperture having a first size and a second aperture having a second size. The one-piece pipe has a first linear portion, a second linear portion, and a curved portion disposed between the first linear portion and the second linear portion. The first linear portion includes a third size. The second linear portion includes a fourth size. The second linear portion extends substantially parallel to the first linear portion. The method further includes defining the first size of the first aperture based on a first difference between the first size and the third size being less than or equal to a predetermined value. The method further includes defining the second size of the second aperture based on manufacturing tolerances of the one-piece pipe and the metal sheet. Defining the second size based on manufacturing tolerances assures that the second linear portion of the one-piece pipe will pass through the second aperture while the first linear portion of the one-piece pipe passes through the first aperture. The method further includes sealingly fixing the first linear portion of the one-piece pipe to the metal sheet. The method further includes expanding the second linear portion to increase the fourth size to an enlarged size until a second difference between the second size and the enlarged size is less than or equal to the predetermined value. The method further includes sealingly fixing the second linear portion of the one-piece pipe to the metal sheet.

In another aspect, a method of manufacturing a subassembly for an exhaust treatment device for receiving exhaust gas from a combustion engine includes providing a first metal sheet, a second metal sheet, and a one-piece pipe. The one-piece pipe has a first linear portion, a second linear portion, and a curved portion disposed between the first linear portion and the second linear portion. The method further includes defining a first size of a first aperture formed in the first metal sheet based on a first difference between the first size of the first aperture and a third size of the first linear portion being less than or equal to a predetermined value. The method further includes defining a second size of a second aperture formed in the second metal sheet based on manufacturing tolerances of the one-piece pipe, the first metal sheet, and the second metal sheet. Defining the second size based on manufacturing tolerances assures that the second linear portion of the one-piece pipe will pass through the second aperture while the first linear portion of the one-piece pipe passes through the first aperture. The method further includes sealingly fixing the first linear portion of the one-piece pipe to the first metal sheet. The method further includes expanding the second linear portion of the one-piece pipe to increase a fourth size of the second linear portion to an enlarged size until a second difference between the second size and the enlarged size is less than or equal to the predetermined value. The method further includes sealingly fixing the second linear portion of the one-piece pipe to the second metal sheet.

In yet another aspect, an exhaust treatment device for receiving exhaust gas from a combustion engine includes a shell, a first metal sheet, a second metal sheet, and a one-piece pipe. The first metal sheet has a first periphery. The first periphery fixedly engages the shell. The second metal sheet has a second periphery. The second periphery fixedly engages the shell. The one-piece pipe is configured to be sealingly fixed to at least one of the shell, the first metal sheet, and the second metal sheet. The one-piece pipe has a first linear portion, a second linear portion, and a curved portion disposed between the first linear portion and the second linear portion. The first linear portion of the one-piece pipe extends through a first aperture that is formed in one of the shell, the first metal sheet, or the second metal sheet. The first aperture has a first size. The first size of the first aperture is defined based on a first difference between the first size and a third size of the first linear portion of the one-piece pipe being less than or equal to a predetermined value. The second linear portion of the one-piece pipe extends through a second aperture that is formed in one of the shell, the first metal sheet, or the second metal sheet. The second aperture has a second size. The second size of the second aperture is defined based on manufacturing tolerances of the one-piece pipe. Defining the second size based on manufacturing tolerances assures that the second linear portion of the one-piece pipe is configured to pass through the second aperture when the first linear portion of the one-piece pipe passes through the first aperture. The second linear portion is configured to be expanded to increase a fourth size of the second linear portion to an enlarged size until a second difference between the second size of the second aperture and the enlarged size is less than or equal to the predetermined value. The first linear portion of the one-piece pipe is configured to be sealingly fixed to a first surface adjacent to the first aperture. The second linear portion of the one-piece pipe is configured to be sealingly fixed to a second surface adjacent to the second aperture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
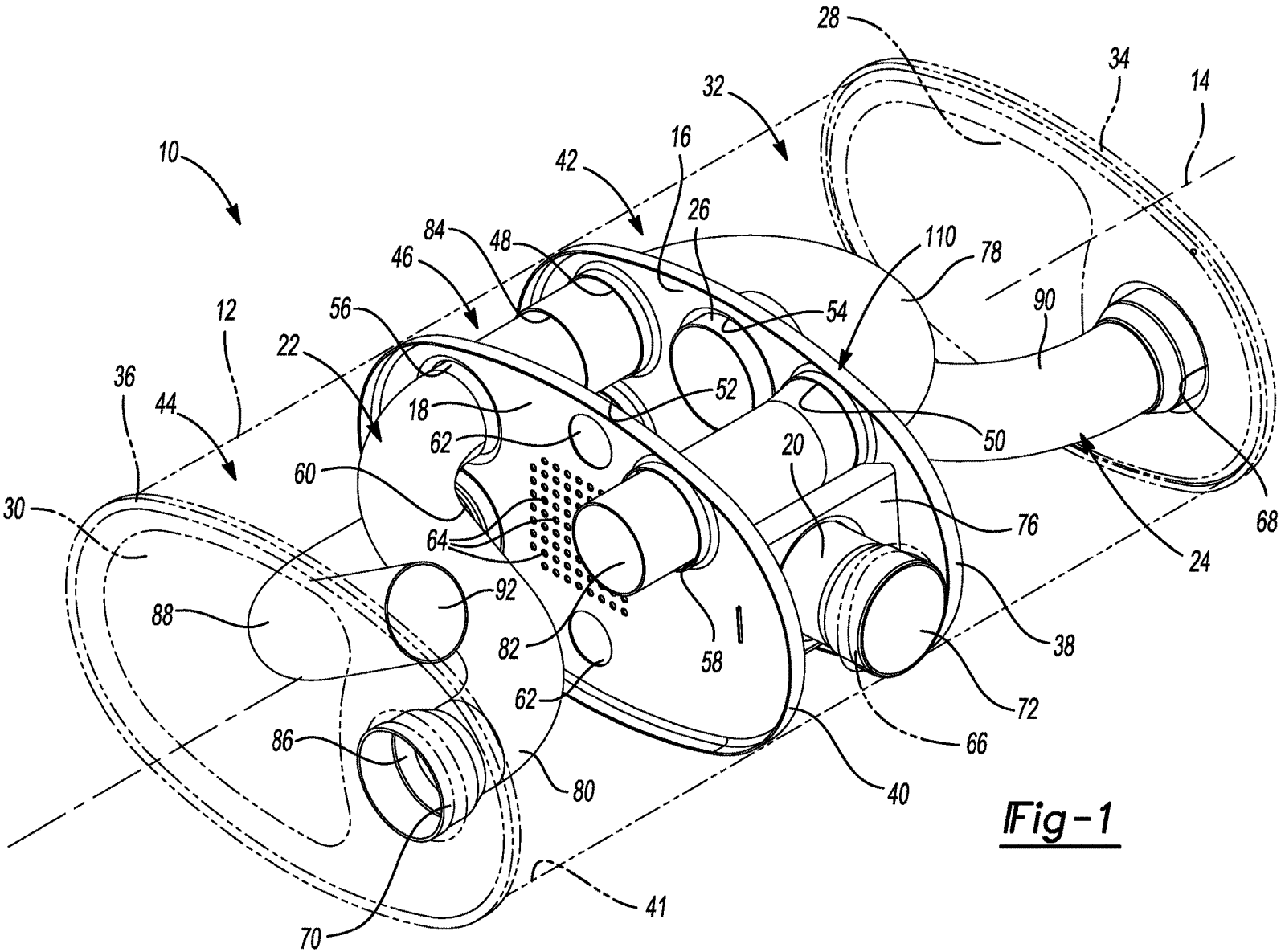
FIG. 1 is an isometric view of a muffler having a pipe and metal sheet subassembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a muffler 10 is provided that may receive exhaust gas from one or more exhaust pipes connected to a combustion engine (not shown). The muffler 10 may be shaped to fit within a given available space on a vehicle (not shown). For example, in some configurations, the muffler 10 may be shaped to fit around a spare tire well of the vehicle and/or other components at or near an undercarriage of the vehicle.

The muffler 10 may include a shell 12 extending along a longitudinal axis 14, a first internal baffle 16, a second internal baffle 18, an inlet pipe 20, a first outlet pipe assembly 22, a second outlet pipe assembly 24, and one or more internal communication pipes 26. The shell 12 may be tubular and may be formed from a metal sheet. A first end cap 28 and a second end cap 30, which may be metal sheets or plates, may be disposed at respective axial ends of the shell 12 and may cooperate with the shell 12 to define an internal volume 32. A first periphery 34 of the first end cap 28 may be sealingly fixed to the shell 12. A second periphery 36 of the second end cap 30 may be sealingly fixed to the shell 12. More specifically, the first and second end caps 28, 30 may be welded, mechanically locked, or otherwise sealingly fixed onto the axial ends of the shell 12. The above components are merely exemplary, and in other embodiments, a muffler according to the principles of the present disclosure may include fewer components (e.g., a single outlet pipe assembly, by way of non-limiting example), or additional components (e.g., a third internal baffle, by way of non-limiting example).

The first and second internal baffles 16, 18, which may be metal sheets or plates, are disposed within the shell 12 and between the first and second end caps 28, 30. That is, the first and second internal baffles 16, 18 may be disposed within the internal volume 32. The first internal baffle 16 may include a third periphery 38 and the second internal baffle 18 may include a fourth periphery 40. The third and fourth peripheries 38, 40 may be shaped to generally match the contours of an inner circumferential wall 41 of the shell 12. The third and fourth peripheries 38, 40 of the first and second internal baffles 16, 18 may be welded, mechanically locked, or otherwise sealingly fixed to the inner circumferential wall 41 of the shell 12.

The first and second internal baffles 16, 18 may divide the internal volume 32 into a first chamber 42, a second chamber 44, and a third chamber 46. The first chamber 42 may be defined by the shell 12, the first end cap 28, and the first internal baffle 16. The second chamber 44 may be defined by the shell 12, the second end cap 30, and the second internal baffle 18. The third chamber 46 may be disposed between the first chamber 42 and the second chamber 44. The third chamber 46 may be defined by the shell 12, the first internal baffle 16, and the second internal baffle 18.

The first internal baffle 16 may include a first aperture 48, a second aperture 50, a third aperture 52, and one or more fourth apertures 54. The second internal baffle 18 may include a fifth aperture 56, a sixth aperture 58, a seventh aperture 60, and one or more eighth apertures 62. The second internal baffle 18 may also include a plurality of openings 64. The shell 12 may include an inlet aperture 66. The first and second end caps 28, 30 may include respective first and second outlet apertures 68, 70.

The inlet pipe 20 may be at least partially disposed in the third chamber 46 and may extend through the inlet aperture 66 in the shell 12. The inlet pipe 20 may include a first inlet opening 72 that may be fluidly coupled with the exhaust pipe (not shown). The inlet pipe 20 may include a first outlet opening (not shown) in fluid communication with the third chamber 46. The inlet pipe 20 may extend through a support plate 76 that is disposed substantially parallel to the longitudinal axis 14 of the shell 12. The support plate 76 may be disposed at least partially within the third chamber 46 and may extend between the first internal baffle 16 and the second internal baffle 18.

The first outlet pipe assembly 22 may be at least partially disposed in the first, second, and third chambers 42, 44, 46. The first outlet pipe assembly 22 may include a first tube (or "one-piece pipe") 78 and a second tube 80. The first tube 78 may include a second inlet opening 82 that is in fluid communication with the second chamber 44. The first tube 78 may extend from the third chamber 46, through the sixth aperture 58 of the second internal baffle 18, into the third chamber 46, through the second aperture 50 of the first internal baffle 16 into the first chamber 42, bend around an angle of about 180°, extend through the first aperture 48 of the first internal baffle 16, and back into the third chamber 46. The first tube 78 may be fluidly sealed to and in fluid communication with the second tube 80 at a first joint 84 in the third chamber 46. The second tube 80 may extend through the fifth aperture 56 in the second internal baffle 18 into the second chamber 44, and through the second outlet aperture 70. The second tube 80 may include a second outlet opening 86 that is open to the ambient environment surrounding the muffler 10 or the outlet opening 86 could be coupled to another exhaust system component outside of the muffler 10 (e.g., a tailpipe, not shown).

The second outlet pipe assembly 24 may be at least partially disposed in the first, second, and third chambers 42, 44, 46. The second outlet pipe assembly 24 may include a third tube 88 and a fourth tube 90. The third tube 88 may include a third inlet opening 92 that is in fluid communication with the second chamber 44. The third tube 88 may extend from the second chamber 44, through the seventh aperture 60 in the second internal baffle 18, into the third chamber 46, through the third aperture 52 in the first internal baffle 16, and into the first chamber 42. The third tube 88 may be fluidly sealed to and in fluid communication with the fourth tube 90 at a second joint (not shown) in the first chamber 42. The fourth tube 90 may extend from the first chamber 42 through the first outlet aperture 68. The fourth tube 90 may include a third outlet opening (not shown) that is open to the ambient environment surrounding the muffler 10 or the outlet opening could be coupled to another exhaust system component outside of the muffler 10 (e.g., a tailpipe, not shown).

The internal communication pipes 26 may respectively extend through the fourth apertures 54 in the first internal baffle 16. The internal communication pipes 26 may be at least partially disposed in the first and third chambers 42, 46 to permit fluid communication between the first and third chambers 42, 46. The eighth apertures 62 and the plurality of openings 64 in the second internal baffle 18 may permit fluid communication between the second and third chambers 44, 46.

Together, the first internal baffle 16 and the first tube 78 (hereinafter "one-piece pipe") may be referred to as a pipe and metal sheet subassembly 110. In other embodiments, "pipe and metal sheet subassembly" may refer to any subassembly for use in an exhaust treatment device that includes a curved one-piece pipe extending through apertures in one or more metal sheets. The curved one-piece pipe may be any one-piece pipe that includes a curved portion disposed between and fluidly connecting first and second linear portions. A metal sheet may be a shell, an end cap, or an internal baffle, partition, or support, by way of non-limiting example.

Figure 2:
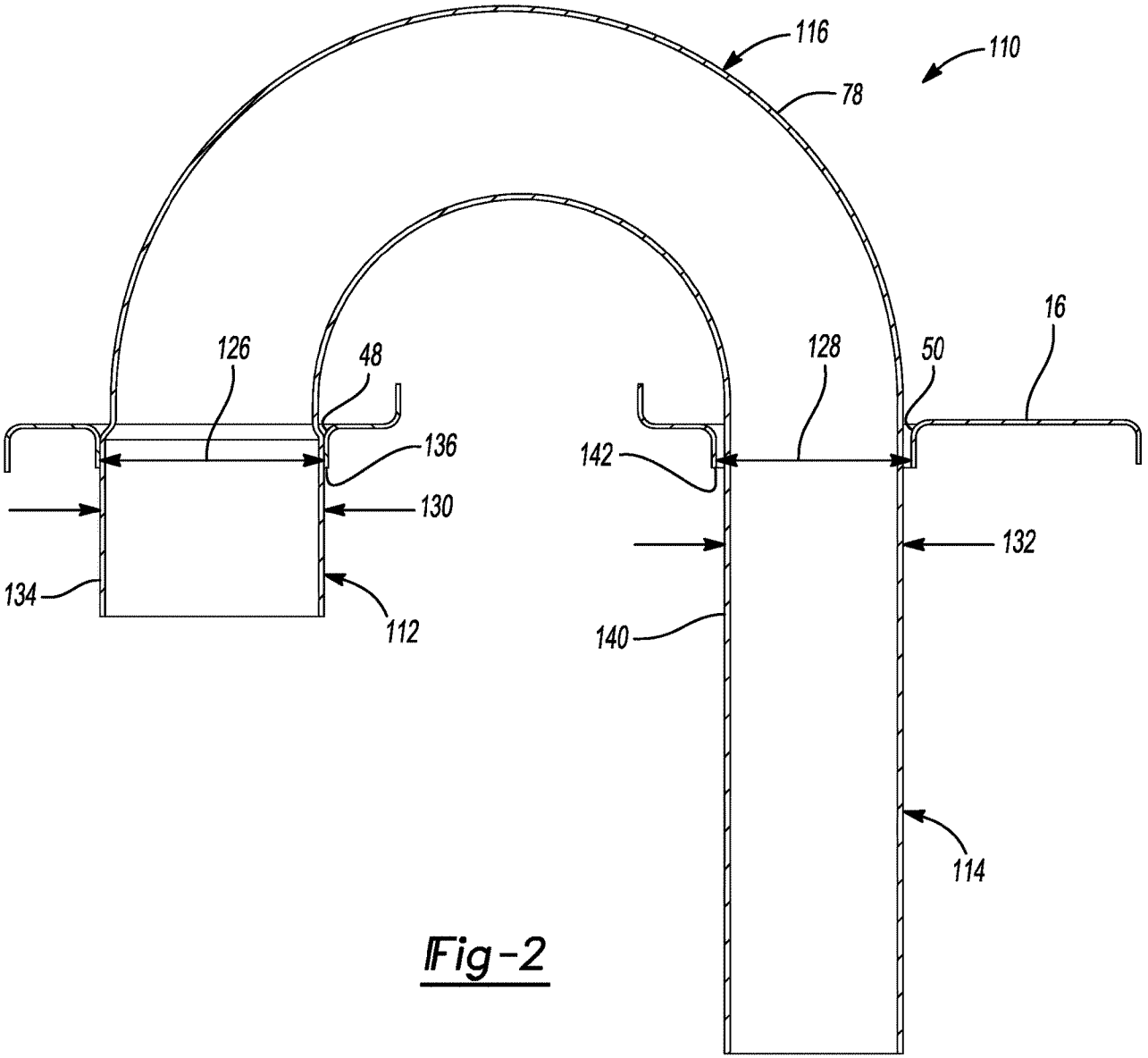
FIG. 2 is a sectional view of the subassembly of FIG. 1.
Figure 3:
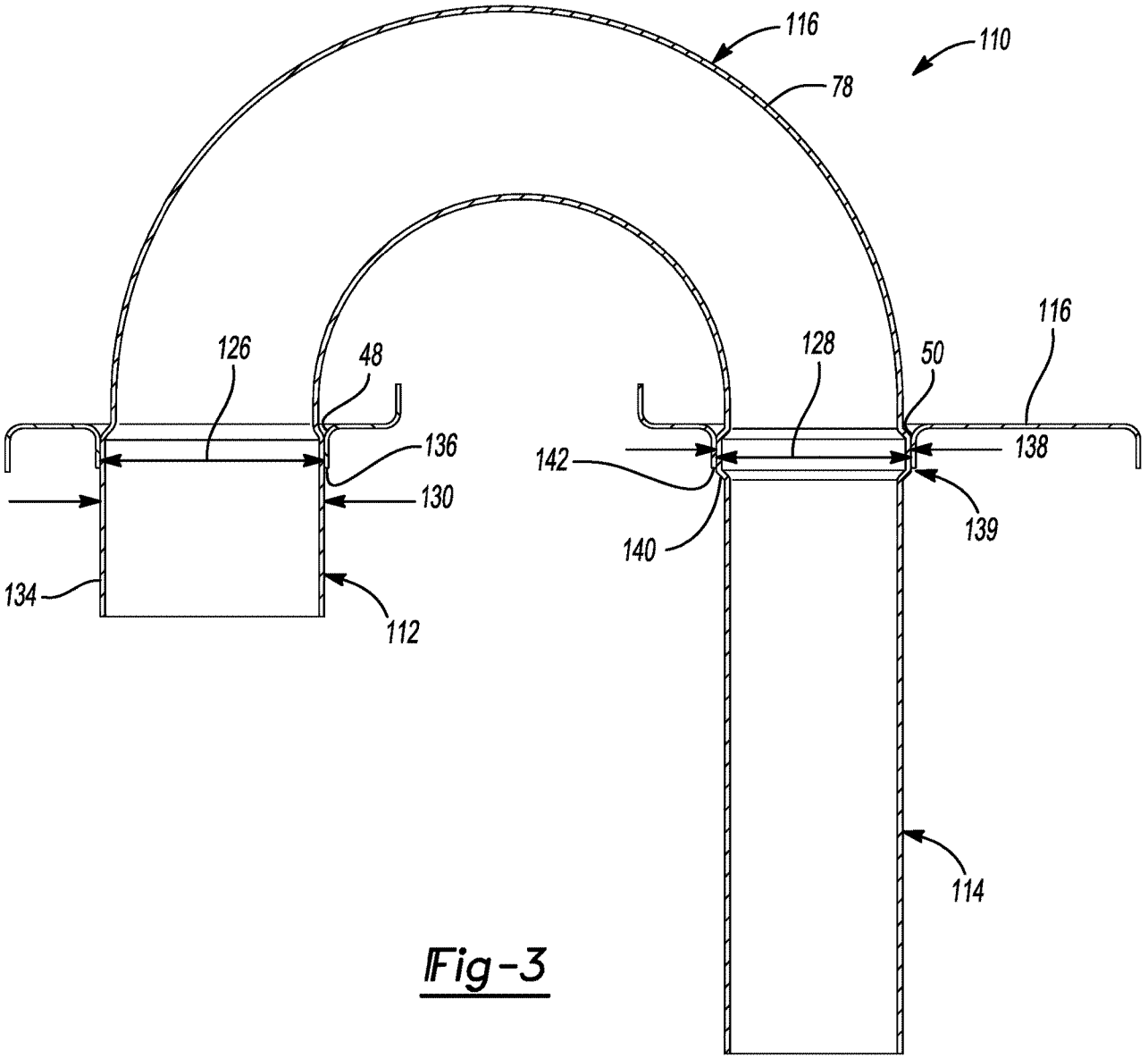
FIG. 3 is a sectional view of the subassembly of FIG. 2, showing a portion of the pipe in an enlarged state.
Figure 4:
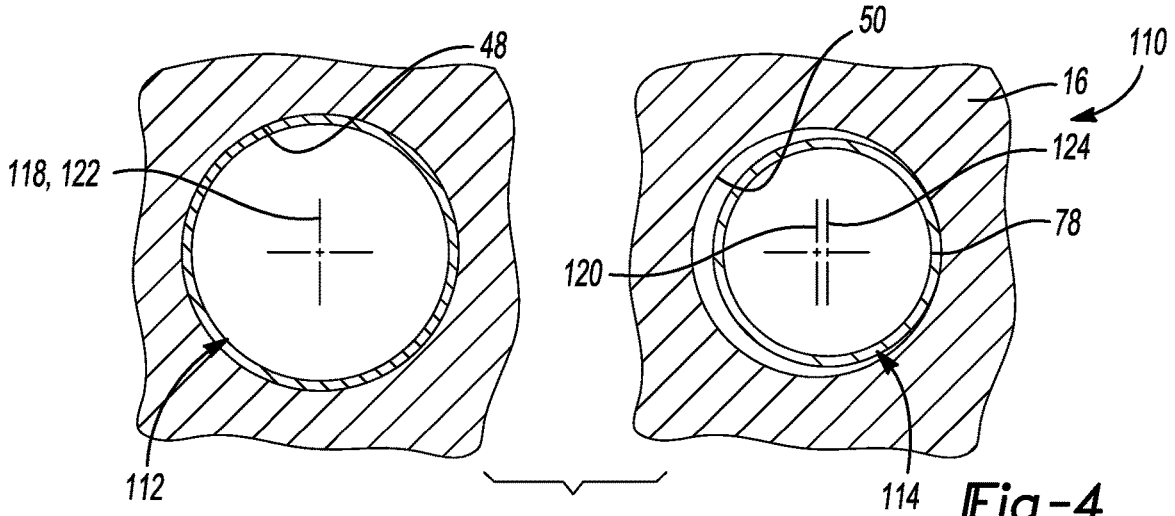
FIG. 4 is a partial sectional view of the subassembly of FIG. 1.

As best shown in FIGS. 2 and 3, the one-piece pipe 78 may include a first linear portion 112, a second linear portion 114, and a curved portion 116 disposed between and fluidly connecting the first and second linear portions 112, 114. As shown in FIG. 4, the first and second apertures 48, 50 may include respective first and second centerlines 118, 120. A first tolerance between the first and second centerlines 118, 120 may be relatively tight (i.e., small). The first and second linear portions 112, 114 of the one-piece pipe 78 may include respective third and fourth centerlines 122, 124. A second tolerance between the third and fourth centerlines 122, 124 may be relatively large. The relatively large second tolerance may result from the bending operation used to form the one-piece pipe.

The large second tolerance between the third and fourth centerlines 122, 124 of the one-piece pipe 78 may result in a difficult and/or costly assembly of the one-piece pipe 78 to the first internal baffle 16. More specifically, if the first and second apertures 48, 50 were sized to match (or slightly exceed) respective outer sizes of the first and second linear portions 112, 114, a given one-piece pipe 78 may not fit into the first and second apertures 48, 50 of the first internal baffle 16 at all. That is, the second linear portion 114 of the one-piece pipe 78 may be unable to pass through the second aperture 50 as the first linear portion 112 of the one-piece pipe 78 passes through the second aperture 50. A nonconforming one-piece pipe 78 may be deformed and forced into position, or scrapped.

In another example, if both the first and second apertures 48, 50 were oversized to accommodate the first tolerance of the one-piece pipe 78, assembly of the one-piece pipe 78 to the first internal baffle 16 may be difficult or result in a joint having a poor quality. More specifically, when welding is used to assemble the one-piece pipe 78 to the first internal baffle 16, a circumferential gap between the linear portions 112, 114 of the one-piece pipe 78 and the respective apertures 48, 50 may be ideally be less than or equal to a predetermined value. When a robotic weld process is used, the predetermined value may be less than or equal to about 1.5 mm, optionally less than or equal to about 1.3 mm, optionally less than or equal to about 1.1 mm, and optionally less than or equal to about 1.0 mm, by way of non-limiting example. If the first and second apertures 48, 50 were oversized, the circumferential gap may be greater than the predetermined value and the weld joint may be weak and/or include fluid leak paths.

Referring to FIGS. 2-5, the pipe and metal plate subassembly 110 is shown. The subassembly 110 may include the one-piece pipe 78 and the first internal baffle 16. The first aperture 48 of the first internal baffle 16 may include a first size 126 and the second aperture 50 of the first internal baffle 16 may include a second size 128. In some embodiments, the first and second apertures 48, 50 may be circular and the first and second sizes 126, 128 may be respective first and second diameters. The first linear portion 112 of the one-piece pipe 78 may include a third size 130. The second linear portion 114 of the one-piece pipe 78 may include a fourth size 132. In some embodiments, the first and second linear portions 112, 114 may be substantially cylindrical and the third and fourth sizes 130, 132 may be respective first and second outer diameters.

A difference or gap (the "first difference") between the first size 126 of the first aperture 48 and the third size 130 of the first linear portion 112 may be less than or equal to the predetermined value. Thus, a tight fit may be provided between the first linear portion 112 and the first aperture 48 such that when the first linear portion 112 is inserted into the first aperture 48, the first linear portion 112 of the one-piece pipe 78 may be welded to the first internal baffle 16. More specifically, an outer surface 134 of the first linear portion 112 may be welded to a first surface 136 of the first internal baffle 16 that is adjacent to the first aperture 48.

A difference or gap (the "oversized gap") between the second size 128 and the fourth size 132 may be greater than the predetermined value (FIGS. 2 and 4). The oversized gap may assure that the second linear portion 114 can pass through the second aperture 50 when the first linear portion 112 passes through the first aperture 48. Thus, various one-piece pipes 78 having the large manufacturing tolerance may all fit within the first and second apertures 48, 50 of the first internal baffle 16. For example, as shown in FIG. 4, the one-piece pipe 78 may include the second linear portion 112 portion that is disposed to the right of the second centerline 120 of the second aperture 50.

Figure 5:
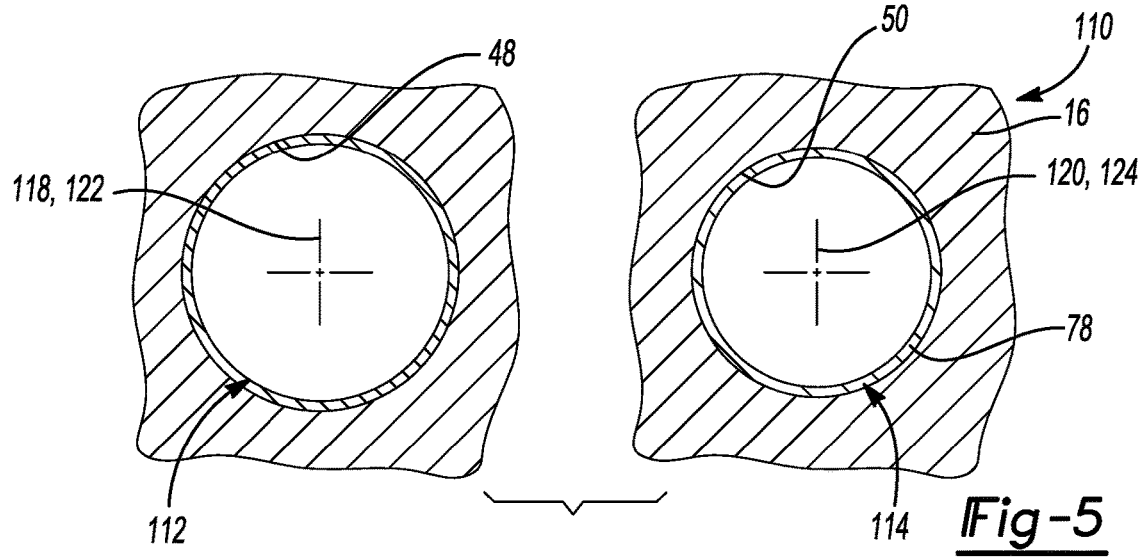
FIG. 5 is a partial sectional view of the subassembly of FIG. 4, showing the portion of the pipe in the enlarged state.

The oversized gap may be too large to enable the second linear portion 114 of the one-piece pipe 78 to be properly welded to the first internal baffle 16. Thus, after the first and second linear portions 112, 114 of the one-piece pipe 78 are inserted into respective first and second apertures 48, 50, the second linear portion 114 can be expanded from the fourth size 132 (FIGS. 2 and 4) to an enlarged size 138 (FIGS. 3 and 5). When the second linear portion 114 has the enlarged size 138, the second centerline 120 of the second aperture 50 may be aligned with the fourth centerline 124 of the second linear portion 114. A difference or gap (the "second difference") between the second size 128 of the second aperture 50 and the enlarged size 138 of the second linear portion 114 of the one-piece pipe 78 may be less than or equal to the predetermined value. The second linear portion 114 may have the enlarged size 138 at an enlarged region 139 (FIG. 3). The enlarged region 139 may be disposed adjacent to the second aperture 50. Thus, a tight fit may be provided between the second linear portion 114 and the second aperture 50 such that the second linear portion 114 can be welded to the first internal baffle 16. More specifically, an outer surface 140 of the second linear portion 114 may be welded to a second surface 142 of the first internal baffle 16 that is adjacent to the second aperture 50. Although the enlarged region 139 is shown as a discrete axial location adjacent to the second aperture 50, in other embodiments the second linear portion 114 may alternatively be expanded along a greater portion of its length. For example, the second linear portion 114 may be expanded along a length extending from an area adjacent to the second aperture 50 the second inlet opening 82.

Although the subassembly 110 is shown and described as being disposed in the muffler 10, the muffler 10 is merely exemplary and the subassembly 110 may be used in other mufflers or other exhaust treatment devices. For example, the subassembly 110 may be used in any exhaust treatment device that includes at least one metal sheet (e.g., a shell, an end cap, or an internal baffle, partition, or support), and a curved one-piece pipe.

Figure 6:
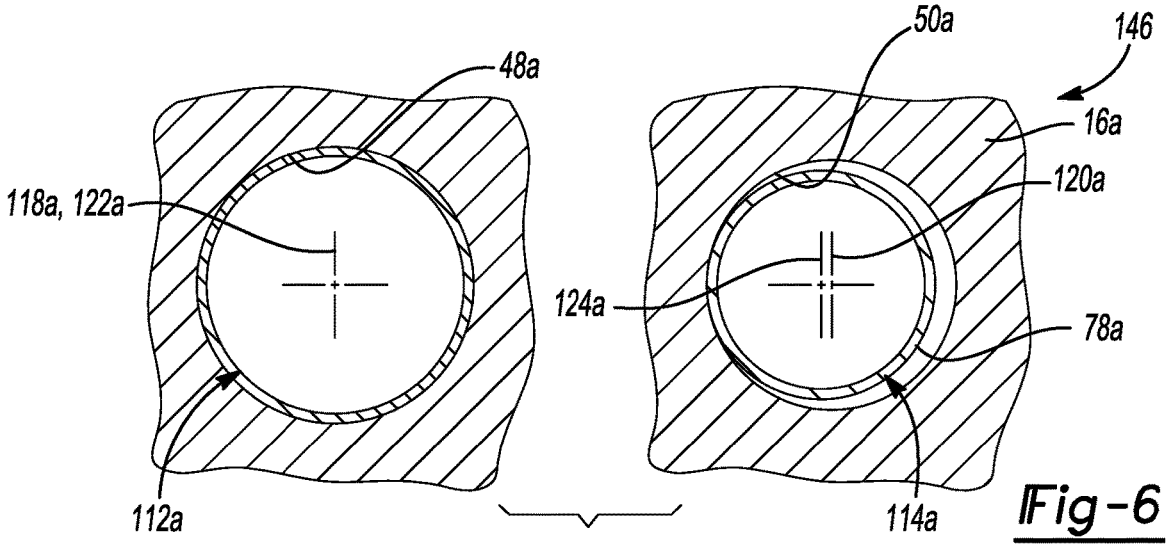
FIG. 6 is a partial sectional view of another subassembly according to the principles of the present disclosure.

As discussed above, an oversized second aperture 50 enables the use of a variety of different one-piece pipes 78 having the large manufacturing tolerance. With reference to FIG. 6, an alternate subassembly 146 is provided. The subassembly 146 may include a baffle 16A having first and second apertures 48A, 50A and a one-piece pipe 78A including first and second linear portions 112A, 114A. The first and second apertures 48A, 50A may have first and second centerlines 118A, 120A. The baffle 16A having first and second apertures 48A, 50A may be similar to the first internal baffle 16 having first and second apertures 48, 50 of FIG. 4. The first and second linear portions 112A, 114A may have third and fourth centerlines 122A, 124A. In contrast to the one-piece pipe 78 of FIG. 4, the fourth centerline 124A may be disposed to the left of the second centerline 120A. Thus, a distance between the third and fourth centerlines 122A, 124A of the one-piece pipe 78A of FIG. 6 may be less than a distance between the third and fourth centerlines 122, 124 of the one-piece pipe 78 of FIG. 4. However, the second linear portions 114, 114A of both one-piece pipes 78, 78A can pass through the respective second apertures 50, 50A when the respective first linear portions 112, 112A pass through respective first apertures 48, 48A. Thus, as demonstrated by FIGS. 4 and 6, the one-piece pipe 78 of FIG. 4 and the one-piece pipe 78A of FIG. 6 are equally capable of being inserted in the apertures of the respective baffles without rework or distortion.

Figure 7:
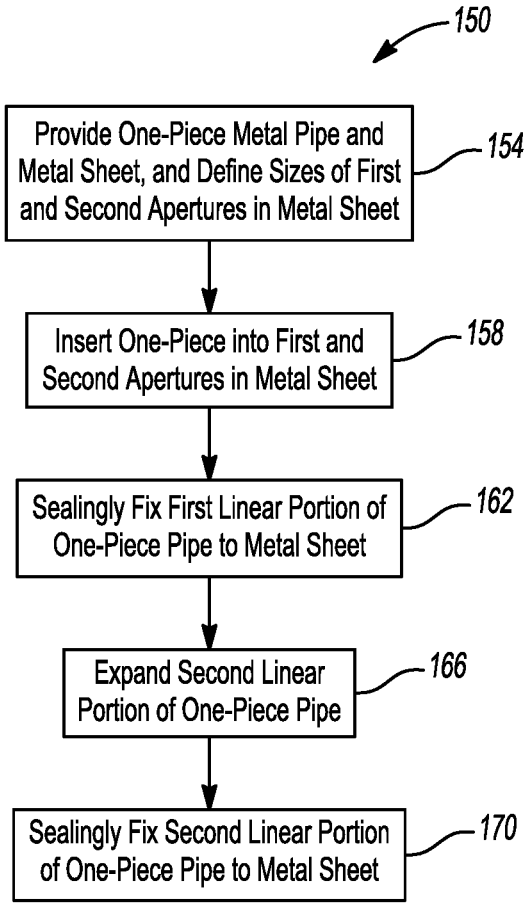
FIG. 7 is a flowchart of a method of manufacturing the subassembly of FIG. 1.

With reference to FIGS. 2-5 and 7, a method 150 of assembling the subassembly 110 will be described. As shown in FIG. 7, at step 154 of the method 150, the one-piece pipe 78 and a metal sheet (e.g., the first internal baffle 16) are provided. Although the metal sheet is shown as the first internal baffle 16, in other embodiments, the metal sheet may be a shell (similar to the shell 12 of FIG. 1), an end cap (similar to the first or second end caps 28, 30 of FIG. 1), or other baffles, partitions, or supports, by way of non-limiting example. Thus, the metal sheet may be any component for an exhaust treatment device having two or more apertures for receiving portions of a curved one-piece pipe.

The one-piece pipe 78 may include the first linear portion 112, the second linear portion 114, and the curved portion 116 disposed between and fluidly connecting the first and second linear portions 112, 114. The first and second linear portions 112, 114 may be substantially parallel to one another. While the first linear portion 112 is shown as having a shorter length than the second linear portion 114, in other embodiments, the first linear portion 112 may be longer than the second linear portion 114 or the first and second linear portions 112, 114 may have substantially the same length. Furthermore, although the curved portion 116 is shown as extending through an angle of about 180°, 180° is merely exemplary and the curved portion 116 may extend through other angles that result in the first and second portions 112, 114 being substantially parallel. For example, the curved portion 116 may include two bends of about 90°. The first linear portion 112 may have the third size 130 and the second linear portion 114 may have the fourth size 132. The third and fourth sizes 130, 132 may be the same or different. Although the one-piece pipe 78 is shown as substantially cylindrical (i.e., the third and fourth sizes 130, 132 are first and second outer diameters), the cylindrical one-piece pipe 78 is merely exemplary and other shapes are contemplated. For example, in other embodiments, a one-piece pipe 78 may have an elongated cross section.

The first internal baffle 16 may include the first and second apertures 48, 50. The first aperture 48 may have the first size 126 and the second aperture 50 may have the second size 128. The first size 126 may be defined based on the first difference between the first size 126 and the third size 130 of the first linear portion 112 of the one-piece pipe 78 being less than or equal to the predetermined value. The second size 128 may be defined based on manufacturing tolerances of the one-piece pipe 78 and the first internal baffle 16 to assure that the second linear portion 114 of the one-piece pipe 78 will pass through the second aperture 50 when the first linear portion 112 of the one-piece pipe 78 passes through the first aperture 48. Thus, the oversized gap between the second size 128 of the second aperture 50 and the fourth size 132 of the second linear portion 114 of the one-piece pipe 78 may be greater than the predetermined value.

At step 158 of the method 150, the one-piece pipe 78 may be inserted into the first and second apertures 48, 50 of the first internal baffle 16. More specifically, the first linear portion 112 of the one-piece pipe 78 may be inserted into the first aperture 48 and the second linear portion 114 of the one-piece pipe 78 may be inserted into the second aperture 50. The third centerline 122 of the first linear portion 112 may be substantially aligned with the first centerline 118 of the first aperture 48 (FIG. 4). The first tolerance between the first linear portion 112 and the first aperture 48 may be relatively tight. The first difference between the first aperture 48 and the first linear portion 112 may be less than or equal to the predetermined value to enable the first linear portion 112 to be welded to the first internal baffle 16.

At step 162 of the method 150, the first linear portion 112 of the one-piece pipe 78 may be sealingly fixed to the first internal baffle 16. Sealingly fixing may include welding. More specifically, the outer surface 134 of the first linear portion 112 may be welded to the first internal baffle 16 at a first surface 136 adjacent to the first aperture 48. After the welding, a position of the one-piece pipe 78 may be fixed with respect to the first interior baffle 16. Due to manufacturing tolerances, the second linear portion 114 may be disposed off center with respect to the second aperture 50. More specifically, the second centerline 120 and the fourth centerline 124 may be offset from one another. For example, the fourth centerline 124 may be disposed to the right (see FIG. 4) or the left (see second centerline 120A and fourth centerline 124A of FIG. 6) of the second centerline 120.

At step 166 of the method 150, the the second linear portion 114 of the one-piece pipe 78 may be expanded from the fourth size 132 to the enlarged size 138. The second linear portion 114 may be expanded using a ridge locking machine, for example. However, the use of a ridge locking machine is merely exemplary and the second linear portion 114 may alternatively be expanded by other tools, such as an expansion mandrel, by way of non-limiting example.

At step 170 of the method 150, the second linear portion 114 of the one-piece pipe 78 may be sealingly fixed to the first internal baffle 16. Sealingly fixing may include welding. More specifically, the outer surface 140 of the second linear portion 114 may be welded to the first internal baffle 16 at the second surface 142 adjacent to the second aperture 50.

The weld locations (i.e., the location where the first linear portion 112 of the one-piece pipe 78 is fixed to the first internal baffle 16 adjacent to the first aperture 48 and the location where the second linear portion 114 of the one-piece pipe 78 is fixed to the first internal baffle 16 adjacent to the second aperture 50) for the subassembly 110 may be advantageously consistently located at the same location on the first internal baffle 16. That is, despite the variance in position of the third centerline 122 of the second linear portion 114 with respect to the third centerline 122 of the first linear portion 112, all one-piece pipes 78 having the manufacturing tolerance can be assembled to the first internal baffle 16 in a similar manner and with an identical welding process. The consistent weld location is particularly advantageous where robotic welding process is used because the welds can always be applied in the same place. The consistent weld locations can lead to cost reduction and improved joints.

The method 150 may optionally further include assembling the subassembly to an exhaust treatment device, such as a muffler (e.g., the muffler 10 of FIG. 1). In one example, the subassembly 110 is fully assembled prior to placing the subassembly 110 within a shell of the exhaust treatment device. In another example, the first internal baffle 16 may already be fixed within the shell when the subassembly 110 is manufactured according to the method 150. Furthermore, in other embodiments, some of the steps of the method 150 may be performed in a different order. For example, step 166 may be completed prior to step 162.

Figure 8:
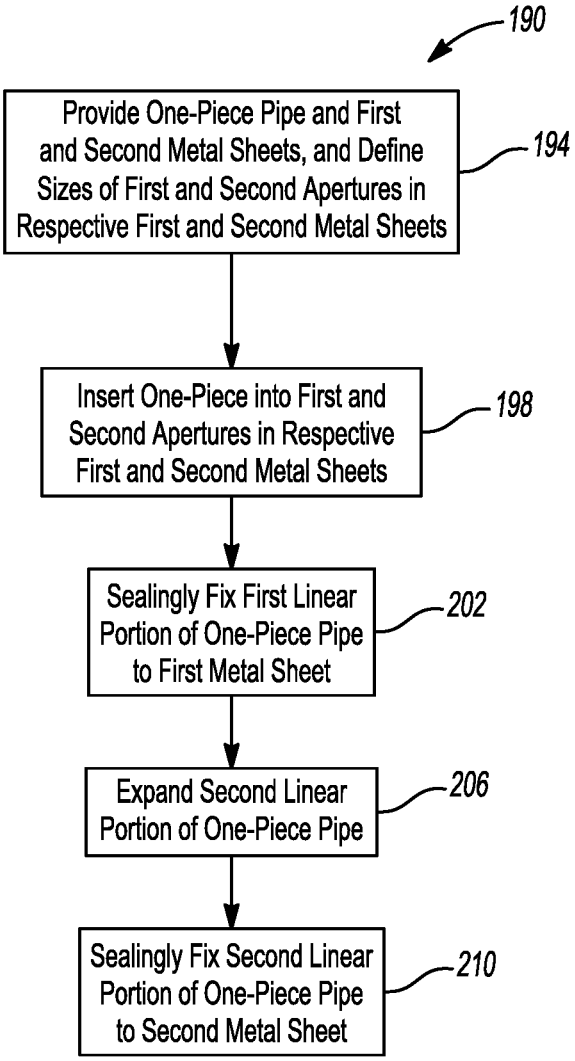
FIG. 8 is a flowchart of a method of manufacturing another subassembly for an exhaust treatment device according to the principles of the present disclosure.

Referring to FIGS. 2-5 and 8, a method 190 of manufacturing another subassembly for an exhaust treatment device will be described. As shown in FIG. 8, at step 194 of the method 190, a one-piece pipe and first and second metal sheets may be provided. The one-piece pipe may include a 180° curved portion (such as a J pipe similar to the one-piece pipe 78 of FIG. 1, or a U pipe), a 90° curved portion, multiple curved portions (such as an S pipe), or any other shape having a curved portion disposed between first and second linear portions. A metal sheet may be a shell (e.g., the shell 12 of FIG. 1), an end cap (e.g., the first and second end caps 28, 30 of FIG. 1), or an internal baffle (e.g., first and second internal baffles 16, 18 of FIG. 1).

A first aperture may be defined in the first metal sheet. A second aperture may be defined in the second metal sheet. In one example, the first metal sheet is a shell, the second metal sheet is an internal baffle, and the one-piece pipe includes a 90° bend (i.e., the first and second linear portions are substantially perpendicular to one another). In another example, the first metal sheet is an internal baffle, the second metal sheet is an end cap, and the one-piece pipe is S-shaped (i.e., the first and second linear portions are substantially parallel to one another). In yet another example, the first metal sheet is an end cap, the second metal sheet is a shell, and the one-piece pipe includes a 90° bend (i.e., the first and second linear portions are substantially perpendicular to one another). In yet another example, the first metal sheet is a first internal baffle, the second metal sheet is a second internal baffle, and the one-piece pipe includes coaxial first and second linear portions and a curved portion that extends through a 90° angle, a 180° angle, and another 90° angle.

A first size of the first aperture may be defined based on a difference between the first size of the first aperture and a third size of a first linear portion of the one-piece pipe being less than or equal to a predetermined value. A second size of the second aperture may be defined based on manufacturing tolerances of the one-piece pipe to assure that a second linear portion of the one piece pipe will pass through the second aperture when the first linear portion of the one-piece pipe passes through the first aperture.

At step 198 of the method 190, the one-piece pipe may be inserted into the first and second apertures. Step 198 may be similar to step 158 of the method 150 of FIG. 7. At step 202, the first linear portion of the one-piece pipe may be sealingly fixed (such as welded) to the first metal sheet. Step 202 may be similar to step 162 of the method 150 of FIG. 7. At step 206, the second linear portion of the one-piece pipe may be expanded to increase the second linear portion from the fourth size to an enlarged size. Step 206 may be similar to step 166 of the method 150 of FIG. 7. At step 210, the second linear portion may be sealingly fixed (such as welded) to the second metal sheet. Step 210 may be similar to step 170 of the method 150 of FIG. 7.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of manufacturing a subassembly for an exhaust treatment device for receiving exhaust gas from a combustion engine, the method comprising:

providing a metal sheet including a first aperture having a first size and a second aperture having a second size, and a one-piece pipe having a first linear portion including a third size, a second linear portion including a fourth size and extending substantially parallel to the first linear portion, and a curved portion disposed between the first linear portion and the second linear portion;

defining the first size of the first aperture based on a first difference between the first size and the third size being less than or equal to a predetermined value;

defining the second size of the second aperture based on manufacturing tolerances of the one-piece pipe and the metal sheet to assure that the second linear portion of the one-piece pipe will pass through the second aperture while the first linear portion of the one-piece pipe passes through the first aperture, wherein a second difference between the second size and the fourth size is greater than the predetermined value;

sealingly fixing the first linear portion of the one-piece pipe to the metal sheet;

expanding the second linear portion to increase the fourth size to an enlarged size until the second difference between the second size and the enlarged size is less than or equal to the predetermined value; and sealingly fixing the second linear portion of the one-piece pipe to the metal sheet.

2. The method of claim 1, wherein the second linear portion of the one-piece pipe is expanded after the first linear portion of the one-piece pipe is fixed to the metal sheet.

3. The method of claim 1, wherein the expanding the second linear portion includes expanding the second linear portion using a ridge locking machine.

4. The method of claim 1, wherein the sealingly fixing the first linear portion of the one-piece pipe to the metal sheet and the sealingly fixing the second linear portion of the one-piece pipe to the metal sheet include welding.

5. The method of claim 1, wherein the subassembly includes a tubular shell and the tubular shell comprises the metal sheet.

6. The method of claim 1, wherein the subassembly comprises an internal baffle including a periphery that is configured to be sealingly fixed to a tubular shell of the exhaust treatment device, and the internal baffle comprises the metal sheet.

7. The method of claim 1, wherein the subassembly comprises an end cap including a periphery that is configured to be sealingly fixed to an axial end of a tubular shell of the exhaust treatment device, and the end cap comprises the metal sheet.

8. The method of claim 1, wherein:

the first aperture and the second aperture are substantially circular, the first size is a first diameter, and the second size is a second diameter; and the first linear portion and the second linear portion are substantially cylindrical, the third size is a first outer diameter, the fourth size is a second outer diameter, and the enlarged size is an enlarged outer diameter.

9. A method of manufacturing a subassembly for an exhaust treatment device for receiving exhaust gas from a combustion engine, the method comprising:

providing a first metal sheet, a second metal sheet, and a one-piece pipe having a first linear portion, a second linear portion extending along a pipe axis, and a curved portion disposed between the first linear portion and the second linear portion;

defining a first size of a first aperture formed in the first metal sheet based on a first difference between the first size of the first aperture and a third size of the first linear portion being less than or equal to a predetermined value;

defining a second size of a second aperture formed in the second metal sheet based on manufacturing tolerances of the one-piece pipe, the first metal sheet, and the second metal sheet to assure that the second linear portion of the one-piece pipe will pass through the second aperture while the first linear portion of the one-piece pipe passes through the first aperture, wherein the second aperture defines an aperture axis;

sealingly fixing the first linear portion of the one-piece pipe to the first metal sheet;

expanding the second linear portion of the one-piece pipe to increase a fourth size of the second linear portion to an enlarged size until a second difference between the second size and the enlarged size is less than or equal to the predetermined value while aligning the pipe axis with the aperture axis; and sealingly fixing the second linear portion of the one-piece pipe to the second metal sheet.

10. The method of claim 9, wherein the second linear portion of the one-piece pipe is expanded after the first linear portion of the one-piece pipe is sealingly fixed to the first metal sheet.

11. The method of claim 9, wherein the expanding the second linear portion includes expanding the second linear portion using a ridge locking machine.

12. The method of claim 9, wherein the sealingly fixing the first linear portion of the one-piece pipe to the first metal sheet and the sealingly fixing the second linear portion of the one-piece pipe to the second metal sheet include welding.

13. The method of claim 9, wherein:

the exhaust treatment device includes a shell, a first end cap having a first periphery sealingly fixed to the shell, a second end cap having a second periphery sealingly fixed to the shell, a first internal baffle having a third periphery sealingly fixed to the shell, and a second internal baffle having a fourth periphery sealingly fixed to the shell;

the first metal sheet is selected from the group consisting of: the shell, the first end cap, the second end cap, the first internal baffle, and the second internal baffle; and the second metal sheet is differently selected from the group consisting of: the shell, the first end cap, the second end cap, the first internal baffle, and the second internal baffle.

14. The method of claim 9, wherein:

the first aperture and the second aperture are substantially circular, the first size is a first diameter, and the second size is a second diameter; and the first linear portion and the second linear portion are substantially cylindrical, the third size is a first outer diameter, the fourth size is a second outer diameter, and the enlarged size in an enlarged outer diameter.

15. An exhaust treatment device for receiving exhaust gas from a combustion engine, the exhaust treatment device comprising:

a shell;

a first metal sheet having a first periphery fixedly engaging the shell;

a second metal sheet having a second periphery fixedly engaging the shell; and a one-piece pipe configured to be sealingly fixed to at least one of the shell, the first metal sheet, and the second metal sheet, the one-piece pipe comprising a first linear portion, a second linear portion, and a curved portion disposed between the first linear portion and the second linear portion, wherein:

the first linear portion of the one-piece pipe extends through a first aperture that is formed in one of the shell, the first metal sheet, or the second metal sheet, the first aperture having a first size;

the first size of the first aperture is defined based on a first difference between the first size and a third size of the first linear portion of the one-piece pipe being less than or equal to a predetermined value;

the second linear portion of the one-piece pipe extends through a second aperture that is formed in one of the shell, the first metal sheet, or the second metal sheet, the second aperture having a second size, the second linear portion of the one-piece pipe having a fourth size;

the second size of the second aperture is defined based on manufacturing tolerances of the one-piece pipe to assure that the second linear portion of the one-piece pipe is configured to pass through the second aperture when the first linear portion of the one-piece pipe passes through the first aperture, wherein a second size difference between the second size and the fourth size is greater than the predetermined value;

the second linear portion is configured to be expanded to increase the fourth size of the second linear portion to an enlarged size until a second difference between the second size of the second aperture and the enlarged size is less than or equal to the predetermined value;

the first linear portion of the one-piece pipe is configured to be sealingly fixed to a first surface adjacent to the first aperture; and the second linear portion of the one-piece pipe is configured to be sealingly fixed to a second surface adjacent to the second aperture.

16. The exhaust treatment device of claim 15, wherein the first linear portion of the one-piece pipe is configured to be welded to the first surface and the second linear portion of the one-piece pipe is configured to be welded to the second surface.

17. The exhaust treatment device of claim 15, wherein:

the first linear portion of the one-piece pipe extends substantially parallel to the second linear portion of the one-piece pipe; and the first aperture and the second aperture are both formed in one of the shell, the first metal sheet, and the second metal sheet.

18. The exhaust treatment device of claim 15, wherein the first linear portion of the one-piece pipe is extends substantially perpendicular to the second linear portion of the one-piece pipe.

19. The exhaust treatment device of claim 15, wherein the first aperture and the second aperture are substantially circular, the first size is a first diameter, and the second size is a second diameter.

20. The exhaust treatment device of claim 15, wherein the first linear portion and the second linear portion are substantially cylindrical, the third size is a first outer diameter, the fourth size is a second outer diameter, and the enlarged size is an enlarged outer diameter.

* * * * *